US009394630B2

(12) United States Patent
Yanagisawa et al.

(10) Patent No.: US 9,394,630 B2
(45) Date of Patent: Jul. 19, 2016

(54) PILLING-RESISTANT ARTIFICIAL LEATHER

(75) Inventors: Satoshi Yanagisawa, Gifu (JP); Hisashi Murahara, Gifu (JP); Katsufumi Yanai, Gifu (JP)

(73) Assignee: Toray Industries, Inc., Tokyo (JP)

( * ) Notice: Subject to any disclaimer, the term of this patent is extended or adjusted under 35 U.S.C. 154(b) by 612 days.

(21) Appl. No.: 13/393,710

(22) PCT Filed: Aug. 30, 2010

(86) PCT No.: PCT/JP2010/064705
§ 371 (c)(1),
(2), (4) Date: Mar. 1, 2012

(87) PCT Pub. No.: WO2011/027732
PCT Pub. Date: Mar. 10, 2011

(65) Prior Publication Data

US 2012/0156416 A1 Jun. 21, 2012

(30) Foreign Application Priority Data

Sep. 3, 2009 (JP) ..... 2009-203488

(51) Int. Cl.

| | |
|---|---|
| ***D01F 8/14*** | (2006.01) |
| ***D01F 1/10*** | (2006.01) |
| ***D01F 6/62*** | (2006.01) |
| ***D06N 3/00*** | (2006.01) |
| ***D01F 6/92*** | (2006.01) |

(52) U.S. Cl.
CPC .. *D01F 8/14* (2013.01); *D01F 1/10* (2013.01); *D01F 6/62* (2013.01); *D01F 6/92* (2013.01); *D06N 3/0004* (2013.01); *D06N 3/0036* (2013.01); *D06N 2211/28* (2013.01); *Y10T 428/2395* (2015.04)

(58) Field of Classification Search
USPC ..... 428/91
See application file for complete search history.

(56) References Cited

U.S. PATENT DOCUMENTS

| | | | | |
|---|---|---|---|---|
| 5,766,760 | A * | 6/1998 | Tsai | D01D 5/247 428/372 |
| 6,479,153 | B1 * | 11/2002 | Kato et al. | 428/423.7 |
| 2007/0166509 | A1 * | 7/2007 | Horiguchi et al. | 428/91 |
| 2007/0212962 | A1 * | 9/2007 | Makimura et al. | 442/96 |
| 2009/0275678 | A1 * | 11/2009 | Kumazawa et al. | 523/523 |

FOREIGN PATENT DOCUMENTS

| | | | |
|---|---|---|---|
| EP | 1041191 | A2 | 10/2000 |
| EP | 1741827 | A1 | 1/2007 |
| JP | 9-157949 | | 6/1997 |
| JP | 11-050368 | | 2/1999 |
| JP | 2002-275748 | | 9/2002 |
| JP | 2004-339617 | | 12/2004 |
| JP | 2004339617 | A * | 12/2004 |
| JP | 2005-208599 | | 8/2005 |
| JP | 2006-045723 | | 2/2006 |
| JP | 2006-63507 | A | 3/2006 |
| JP | 2009-13543 | A | 1/2009 |
| WO | WO 2007/040144 | A1 | 4/2007 |

OTHER PUBLICATIONS

International Search Report dated Dec. 7, 2010, application No. PCT/JP2010/064705.
Supplementary European Search Report dated May 29, 2013, application No. EP10813681.

* cited by examiner

*Primary Examiner* — Katarzyna Wyrozebski
*Assistant Examiner* — Kevin Worrell
(74) *Attorney, Agent, or Firm* — RatnerPrestia

(57) ABSTRACT

An artificial leather is provided having a raised nap to give an elegant appearance, and further has a good pilling-resistance without affecting the spinning performance. The pilling-resistant artificial leather is a sheet-form object including a microfiber having a monofilament diameter of 0.3 to 10 μm and a polymeric elastomer, and having a raised nap made of the microfiber. The microfiber includes inorganic particles in a proportion of 0.01 to 5% by mass relative to 100% by mass of the microfiber, and a silicone oil in a proportion of 0.001 to 1% by mass relative to 100% by mass of the microfiber. The microfiber contains a polyester microfiber in a proportion of 90% by mass or more thereof.

8 Claims, No Drawings

PILLING-RESISTANT ARTIFICIAL LEATHER

CROSS REFERENCE TO RELATED APPLICATIONS

This application is the U.S. National Phase application of PCT International Application No. PCT/JP2010/064705, filed Aug. 30, 2010, and claims priority to Japanese Patent Application No. 2009-203488, filed Sep. 30, 2009, the disclosure of both applications being incorporated herein by reference in their entireties for all purposes.

FIELD OF THE INVENTION

The present invention relates to an artificial leather which has a surface having a raised nap to give an elegant appearance, and further has a good pilling-resistance.

BACKGROUND OF THE INVENTION

A suede-like artificial leather having a surface having a raised nap made of a microfiber has a soft feeling, excellent physical properties, and an elegant appearance, and hitherto the leather has widely been used for clothing, furniture, vehicle interior materials, and others. Such a suede-like artificial leather, which has a surface having a raised nap made of a microfiber, has a structure wherein a sheet-form object made of the microfiber is impregnated with an elastic polymer. Thus, the artificial leather has the following problem: when the artificial leather is actually used, the leather is worn away so that the filaments of the microfiber are entangled with each other to turn to pills, that is, the so-called pilling is generated. Against this problem, various suggestions have been made so far.

Specifically, for the prevention of the pilling of a suede-like artificial leather, suggested is a method about a suede-like artificial leather composed of an entangled nonwoven fabric made of polyester microfiber bundles having a monofilament fineness of 0.2 to 0.005 dtex, and an elastic polymer, wherein silica having a particle diameter of 100 nm or less is incorporated into the polyester microfiber in a proportion of 0.5 to 10% by mass to the microfiber (Patent Document 1). However, according to this suggestion, it is necessary to incorporate inorganic particles of silica into the polyester microfiber. Thus, this suggestion has the following problem: in spinning into the fiber, coarse particles wherein the inorganic particles aggregate secondarily are generated; thus, the filtration pressure is raised, so that thread breakage is caused; it is therefore difficult to continue the spinning over a long period. Additionally, this suggestion has another problem that when a raised nap is formed in the surface of the artificial leather, filaments in the nap-raised regions are cut so that the length of the raised nap turns short, whereby an elegant raised nap cannot be formed.

Suggested is also a method about a suede-like artificial leather made of a polyethylene terephthalate microfiber having a monofilament fineness of 0.5 dtex or less, and a polyurethane resin, wherein the intrinsic viscosity of the polyethylene terephthalate is set into the range of 0.57 or more and 0.63 or less, thereby reducing the strength of the polyethylene terephthalate microfiber not to cause pilling (Patent Document 2). Although this suggestion can overcome pilling by setting the intrinsic viscosity of the microfiber into a low value and thus lowering the thread strength, this suggestion has a problem that the artificial leather itself is deteriorated in physical properties such as tensile strength and tear strength.

Separately, suggested is a long-fiber nonwoven fabric made of a peeling-separation type composite fiber wherein inorganic particles, a silicone oil and others are added to at least one component of a polyamide polymer and a polyester polymer (Patent Document 3). However, in this suggestion, the silicone oil is added to make easy the separation of the peeling-separation type composite fiber, and the inorganic particles are added to adjust the coloring effect and the cross sectional shape of the fiber filaments. Furthermore, in working examples of Patent Document 3, specifically, neither silicone oil nor inorganic particles are added to any polymer, so that no pilling-resistance is expressed.

PATENT DOCUMENTS

Patent Document 1: JP-A-2004-339617
Patent Document 2: JP-A-2006-045723
Patent Document 3: JP-A-2002-275748

SUMMARY OF THE INVENTION

Thus, in light of the problems in the prior art, this invention provides an artificial leather having a raised nap to give an elegant appearance, and further has a good pilling-resistance without affecting the spinning performance.

In order to solve the problems, the invention according to exemplary embodiments employs the following means: The pilling-resistant artificial leather of embodiments of the invention is a sheet-form object including a microfiber having a monofilament diameter of 0.3 to 10 μm and a polymeric elastomer, and having a raised nap made of the microfiber, wherein the microfiber contains inorganic particles in a proportion of 0.01 to 5% by mass relative to 100% by mass of the microfiber, and a silicone oil in a proportion of 0.001 to 1% by mass relative to 100% by mass of the microfiber.

According to a preferred embodiment of the pilling-resistant artificial leather of the invention, the microfiber contains a polyester microfiber in a proportion of 90% by mass or more to the microfiber. According to a further preferred embodiment of the pilling-resistant artificial leather of the invention, the microfiber contains a polyester microfiber in a proportion of 100% by mass to the microfiber.

According to a preferred embodiment of the pilling-resistant artificial leather of the invention, the inorganic particles are inorganic particles of at least one selected from the group consisting of calcium salts, silica, and titanium oxide.

According to embodiments of the invention, inorganic particles are added to a microfiber in a proportion of 0.01 to 5% by mass to the microfiber, and further a silicone oil is incorporated thereinto in a proportion of 0.001 to 1% by mass to the microfiber, thereby making it possible to efficiently prevent the inorganic particles from aggregating secondarily. By dispersing the inorganic particles evenly in the polyester microfiber, the microfiber can be prevented from being turned into a pilling state by abrasion.

When the inorganic particles aggregate secondarily in the microfiber, the strength of the microfiber lowers so that the fiber filaments in the surface of the artificial leather are cut. As a result, the artificial leather cannot gain an elegant appearance. However, the added silicone oil can prevent the particles from aggregating secondarily, thereby making it possible to prevent the pilling of the leather while keeping the strength and the elegant appearance of the microfiber.

Furthermore, in a case where the inorganic particles aggregate secondarily at the time of spinning into the microfiber, the spinning performance is deteriorated, for example, breakage is caused; thus, it is difficult to continue the spinning over a long period. However, the incorporation of the silicone oil as well as the inorganic particles makes it possible to disperse the inorganic particles evenly in the microfiber to keep the spinning performance and continue the spinning over a long period.

DETAILED DESCRIPTION OF EMBODIMENTS OF THE INVENTION

The artificial leather of embodiments of the invention, which is good in pilling-resistance, is a sheet-form object containing a microfiber, and a polymeric elastomer, and has an excellent surface appearance like that of a natural leather, such as suede or nubuck, and is preferably a sheet-form object having not only a nap-raising appearance like that of suede or nubuck but also a smooth touch and an excellent lighting effect.

The proportion of the polyester microfiber to fiber(s) that constitute the pilling-resistant artificial leather of the invention is preferably 40% by mass or more and 100% by mass or less, more preferably 60% by mass or more and 100% by mass or less of the whole of the fiber (s) to make it possible to create an elegant appearance.

It is beneficial that the monofilament diameter of the microfiber used is from 0.3 to 10 μm. It is more preferred for producing a product giving a good touch that the monofilament diameter is smaller. The diameter is preferably from 0.3 to 5.3 μm, more preferably from 0.3 to 4.6 μm.

The monofilament diameter of the fiber(s) constituting the artificial leather may be obtained as follows: When sections of the fiber filaments are each in the form of a circle or an ellipse close to a circle, a scanning electron microscopic (SEM) photograph of the surface of the artificial leather is taken with a 2000-power; 100 fiber filaments are selected therefrom at random; the monofilament diameters thereof are measured; and the average monofilament diameter thereof is calculated; the resultant value is defined as the monofilament diameter. When the fiber filaments constituting the artificial leather each have a deformed section, similarly the diameter of the outer circumferential circle of the deformed sections is calculated out as the filament diameter. Furthermore, in a case where circular sections and deformed sections are mixed with each other or monofilaments largely different from each other in monofilament fineness are mixed with each other, or in some other case, 100 filaments are selected therefrom to make the respective numbers of the different filaments substantially equal to each other. In the case of the deformed sections, the sectional area thereof is converted to the area of the complete circle to calculate out the monofilament diameter.

The microfiber used in the invention contains a polyester component preferably in a proportion of 90% by mass or more thereof, and most preferably the microfiber is made of a single component of polyester. If the proportion of the polyester component is less than 90% by mass, fibers different from each other in fiber strength elongation or some other nature are intermingled with each other so that about some of the fibers, filaments thereof are easily entangled with each other. Thus, pilling is easily caused so that the pilling-resistance deteriorates. If the proportion of the polyester component is less than 90% by mass, a difference is generated in dye-adsorption between the fibers constituting the artificial leather when the fibers are dyed. Thus, the artificial leather easily becomes uneven in color. As a result, an elegant appearance tends not to be easily obtained.

About the microfiber used in the invention, a component thereof is preferably polyester from the viewpoint of light resistance and other endurances when the artificial leather is actually used. Examples of the polyester include polyethylene terephthalate, polybutylene terephthalate, polytrimethylene terephthalate, and polylactic acid. The polyester is in particular preferably polyethylene terephthalate since the polyester can give better endurances.

The microfiber used in embodiments of the invention contains therein inorganic particles and a silicone oil. It is beneficial that the content of the inorganic particles ranges from 0.01 to 5% by mass relative to 100% by mass of the microfiber.

If the content of the inorganic particles is too small, the artificial leather cannot exhibit a sufficient pilling-resistance. If the content of the inorganic particles is too large, fiber physical properties suitable for practical use cannot be retained, and further when a raised nap is produced in the artificial leather surface, the filaments in the nap-raised regions are cut so that the length of the raised nap is made short. As a result, the produced raised nap is not elegant. Additionally, if the content of the inorganic particles is too large, the particles aggregate secondarily to turn to coarse particles at the time of spinning into the microfiber, so that the coarse particles raise the filtration pressure. As a result, thread breakage is caused; therefore, the spinning cannot be continued over a long period. Thus, the content of the inorganic particles is preferably from 0.1 to 3% by mass.

The inorganic particles used in the invention need only not to function as a catalyst in the polymerization into the polyester to produce a remarkable effect onto the reaction rate. The inorganic particles are preferably inorganic particles of at least one selected from the group consisting of calcium salts such as calcium carbonate, calcium chloride and calcium sulfate, silica, and titanium oxide since the inorganic particles are satisfactorily dispersed in the polyester. The inorganic particles may be inorganic particles obtained by combining the inorganic particles of two or more of these species with each other. The inorganic particles are preferably inorganic particles of at least one selected from calcium carbonate, silica, and titanium oxide.

The inorganic particles that function as a catalyst in the polymerization into the polyester to produce a remarkable effect onto the reaction rate are, for example, antimony trioxide-based or some other antimony-based inorganic particles, germanium-based inorganic particles, titanium-chelate-based or some other titanium (from which titanium oxide is excluded)-based inorganic particles, or aluminum-based inorganic particles.

If the average particle diameter of the inorganic particles used is too large, the fiber strength or the spinning performance deteriorates. If the diameter is too small, a sufficient pilling-resistant effect is not obtained. Thus, the average particle diameter of the inorganic particles is preferably from 0.1 to 300 nm, more preferably from 1 to 100 nm.

The average particle diameter of the inorganic particles used in the invention may be determined as follows: From the inorganic particles, 0.01 g of a fraction is collected, and the fraction is photographed with a scanning electron microscope (SEM) or a transmission electron microscope (TEM) with a power permitting the shape of the inorganic particles to be distinct in the range of a 10000-power to a 5000-power. Therefrom, 100 particles are selected at random, and the average particle diameter thereof is calculated out. The resultant value is defined as the particle diameter of the inorganic particles.

Preferred specific examples of the inorganic particles include calcium carbonate particles having an average particle diameter of 50 nm (CALFINE 200M, manufactured by Maruo Calcium Co., Ltd.), super high purity colloidal silica having an average particle diameter of 35 nm (PL-3, manufactured by Fuso Chemical Co., Ltd.), and titanium oxide having an average particle diameter of 30 to 50 nm (TTO-55, manufactured by Ishihara Sangyo Kaisha, Ltd.).

The silicone oil used in the invention needs only to be oily silicone having a main skeleton based on siloxane bonds. When the silicone oil has a substituent, the substituent may be, for example, a polyether, an epoxy group, any amine, a carboxyl group, an alkyl group such as a methyl group, or a phenyl group.

The silicone oil is preferably polydimethylsiloxane since the versatility is high. A versatile silicone oil is, for example, a polydimethylsiloxane oil (SH200, manufactured by Dow Corning Toray Co., Ltd.). When the artificial leather original substance is treated at a high temperature of 150° C. or higher, polymethylphenylsiloxane, which is high in heat resistance, is preferably used. A usable heat-resistant silicone oil is, for example, a heat-resistant methylphenylsilicone oil (KF-54, manufactured by Shin-Etsu Chemical Co., Ltd.), or a heat-resistant dimethylsilicone oil (SH510, manufactured by Dow Corning Toray Co., Ltd., or KF-965 or KF-968, manufactured by Shin-Etsu Chemical Co., Ltd.). When emphasis is placed on compatibility with the polyester, a usable silicone oil is an alkyl-modified silicone oil (SF8416, BY16-846, SH203, or SH230, manufactured by Dow Corning Toray Co., Ltd.).

By incorporating the silicone oil together with the inorganic particles into the microfiber, the silicone oil hinders the aggregation of the inorganic particles in the polyester, which preferably constitutes the microfiber, so that the microfiber formed can be a microfiber wherein the inorganic particles are evenly dispersed. For this reason, when the silicone is added to be together used than when only the inorganic particles are incorporated into the microfiber, a smaller amount of the inorganic particles can improve the artificial leather in pilling-resistance. The addition of the silicone also makes it possible to prevent the inorganic particles from aggregating with each other. Thus, thread breakage is reduced so that the original substance is improved in spinning performance, and further the resultant fiber filaments are improved in breaking strength.

If the content of the silicone oil in the microfiber is too small, the effect of preventing the inorganic particles from aggregating is small so that the filtration pressure at the time of the spinning is raised. Thus, it is difficult to continue the spinning over a long period. If the content of the silicone oil is too large, the oil adheres to facilities for the spinning so that the control of the facilities becomes troublesome. Additionally, the oil component is unevenly dispersed so that the stability of the spinning deteriorates and the facilities deteriorate in operability. Thus, the content of the silicone oil in the microfiber is from 0.001 to 1% by mass relative to 100% by mass of the microfiber, preferably from 0.001 to 0.1% by mass thereof.

If the breaking strength of the microfiber used is too weak, the sheet-form object is too weak in strength to be practically used. If the breaking strength is too strong, the artificial leather does not become smooth in touch and further the microfiber filaments are easily entangled with each other so that pilling is easily generated. Thus, the breaking strength of the microfiber is preferably from 0.2 to 0.5 cN/μm.

Examples of the polymeric elastomer used in the invention include a polyurethane resin, an acrylic resin, and a silicone resin. These resins may be used in combination. Of these resins, the polyurethane resin is in particular preferably used as the polymeric elastomer from the viewpoint of the expression of the endurance of the artificial leather.

The polyurethane resin used in the invention may be a resin having a structure obtained by causing a polyol, a polyisocyanate and a chain extender to react with each other appropriately. The polyurethane resin may be either a solvent type polyurethane resin or a water-dispersed type polyurethane resin.

The polyurethane resin may contain a different resin, for example, an elastomer resin of a polyester type, a polyamide type, a polyolefin type or some other type, an acrylic resin, or an ethylene/vinyl-acetate resin as far as the polyurethane resin is not damaged in performance for acting as a binder, or the artificial leather is not damaged in texture.

The polyurethane resin may contain various additives, such as a pigment such as carbon black, a phosphorus-based, a halogen-based, an inorganic substance-based, or some other substance-based flame retardant, a phenol-based, a sulfur-based, a phosphorus-based or some other substance-based antioxidant, a benzotriazole-based, a benzophenone-based, a salicylate-based, a cyanoacrylate-based, an oxalic acid anilide-based or some other substance-based ultraviolet absorbent, a hindered amine-based, a benzoate-based or some other substance-based light stabilizer, a hydrolysis-resistant stabilizer such as polycarbodiimide, a plasticizer, an antistatic agent, a surfactant, a solidification adjuster, and a dye.

In the invention, a commercially available product of the polymeric elastomer may be used, examples thereof including a solution type urethane resin ("CRISVON" (registered trade name) MP-812NB, manufactured by DIC Corp.), and an aqueous type urethane resin ("HYDRAN" (registered trade name) WLI-602, manufactured by DIC Corp.).

In the pilling-resistant artificial leather of the invention, the proportion (percentage) of the polymeric elastomer to the artificial leather is preferably 10% by mass or more and 50% by mass or less, more preferably 15% by mass or more and 35% by mass or less. When the proportion (percentage) of the polymeric elastomer is set to 10% by mass or more, the artificial leather can gain a strength necessary for a sheet-form object, and further the fiber filaments can be prevented from falling out. When the proportion (percentage) of the polymeric elastomer is set to 50% by mass or less, the texture can be prevented from becoming hard to gain a good quality of a raised nap, which is a target quality.

The pilling-resistant artificial leather of the invention can be favorably used for furniture, chairs, and wall materials; interior materials having very elegant appearances for outer surface members of seats, ceilings and interior panels inside vehicles rooms of automobiles, trains, airplanes and others; materials for clothing, which are each used in shirts or jackets, uppers, trims and others of causal shoes, sports shoes, shoes for gentlemen and ladies, or other shoes, bags, belts and wallets, and parts of these articles; and industrial members, such as wiping cloths, polishing cloths, CD curtains, and others.

The following describes a method for producing the pilling-resistant artificial leather of the invention. An example described herein is an example of a production method wherein polyester is used as a polymer constituting a microfiber.

The method for incorporating inorganic particles and a silicone oil into polyester, which favorably constitutes the microfiber, may be a method in which at the time of polymerization into polyester, the inorganic particles and the silicone oil are added. Examples thereof include a method (A) of preparing, in advance, a polyester species containing the inorganic particles and the silicone oil, which may each be of any type, and using raw materials depolymerized therefrom to cause a polymerization reaction, a method (B) in which just before the start of an esterification reaction between terephthalic acid and ethylene glycol or at any stage during the reaction, the inorganic particles and the silicone oil, which may each be of any type, are added thereto, and a method (C) in which just before the start of an esterification reaction between terephthalic acid and ethylene glycol or at any stage during the reaction, the inorganic particles and the silicone oil, which may each be of any type, are added thereto.

The method for adding the inorganic particles and the silicone oil to polyester is preferably a method as described above, which is a method of preparing, in advance, a polyester species containing the inorganic particles and the silicone oil, which may each be of any type, and using raw materials depolymerized therefrom to cause a polymerization reaction. By the use of this method, the inorganic particles and the silicone oil are sufficiently stirred during the depolymerization and the polymerization, so that the inorganic particles and the silicone oil are made affinitive with each other. Thus, the dispersibility of the inorganic particles in polyester becomes very good. From the viewpoint of a decrease in load to the environment, the polyester species containing, in advance, the inorganic particles and the silicone oil, which may each be of any type, is preferably a recycled material obtained by collecting fiber wastes, film wastes and polyester species used for PET bottles, and then reusing these collected substances.

The method for adding the silicone oil to polyester may be a method of melt-spinning a substance wherein the silicone oil is beforehand given to the surface of polyester chips, thereby incorporating the silicone oil into the microfiber.

The method for yielding the microfiber constituting the artificial leather used in the invention may be a method of yielding the microfiber directly, or a method of producing a microfiber-manifesting type fiber once, and then manifesting the microfiber therefrom. A method used preferably in the invention is the latter method of producing a microfiber-manifesting type fiber once, and then manifesting the microfiber therefrom since the microfiber can easily gain a smaller fineness and the resultant artificial leather is soft. The method may be, for example, a method of spinning polymers different from each other in solubility together to yield a microfiber-manifestable fiber, and then removing at least one of the polymers to form the microfiber.

The composite form used at the time of the spinning into the microfiber-manifesting type fiber is preferably a side-by-side composite form, which is in the state that pieces of the polymers are laminated onto each other, or a sea-island type composite form, wherein a polymer is present in the form of islands in another polymer.

The polymer to be removed is preferably a polyolefin such as polyethylene or polystyrene; an alkali-solubility-enhanced copolymerized polyester obtained by copolymerizing sodium sulfoisophthalate, and polyethylene glycol or some other; polylactic acid; or some other polymer.

The method for manifesting the polyester microfiber may be varied in accordance with the kind of the component to be removed. When the component to be removed is a polyolefin such as polyethylene or polystyrene, the method is preferably a method of immersing the microfiber-manifesting type fiber in an organic solvent such as toluene or trichloroethylene to perform extraction. When the component to be removed is the alkali-solubility-enhanced copolymerized polyester or polylactic acid, the method is preferably a method of immersing the microfiber-manifesting type fiber in an aqueous solution of an alkali such as sodium hydroxide to perform extraction.

The following describes a method for making the microfiber or the microfiber-manifesting type fiber into a sheet form to yield a sheet-form object.

The sheet-form object may be any one of a textile, a knitting, a nonwoven fabric made of short fiber filaments, and a nonwoven fabric made of long fiber filaments. However, when emphasis is placed on feeling and quality, a nonwoven fabric made of short fiber filaments is preferably used. The method for yielding the nonwoven fabric made of short fiber filaments may be a method using a card machine or a cross lapper, or a papermaking method. Filaments of the nonwoven fabric yielded by such a method may be entangled with each other by needle punch or water jet punch, or may be entangled with a different textile, knitting or nonwoven fabric, or integrated therewith through adhesion or some other.

The textile, knitting and nonwoven fabric to be integrated may each contain inorganic particles and/or a silicone oil in the same manner as in the microfiber. The fiber contained in the textile, knitting or nonwoven fabric to be integrated may be exposed to the surface of the artificial leather, and the exposed fiber easily turns into pilling since the fiber is different in property form the microfiber.

The content of the inorganic particles in the fiber used in the textile, knitting or nonwoven fabric to be integrated is preferably from 0.1 to 3% by mass in the same manner as in the microfiber. The content of the silicone oil is preferably from 0.001 to 1% by mass in the same manner as in the microfiber. The method for incorporating the inorganic particles and the silicone oil into the fiber may be a method equivalent to the method for incorporating the inorganic particles and the silicone oil into the microfiber. The following method is in particular preferably used from the viewpoint of a decrease in load to the environment: a method of using, as a polyester fiber raw material, a recycled material obtained by collecting fiber wastes, film wastes and polyester species used for PET bottles as a raw material which contains, in advance, inorganic particles and a silicone oil that may be of any type, and then reusing these collected substances.

The method that can be adopted to produce the pilling-resistant artificial leather of the invention may be a method of producing the microfiber initially, and then making the microfiber into a sheet form, or a method of making the above-mentioned microfiber-manifesting type fiber into a sheet form, and then subjecting the sheet to the above-mentioned treatment to manifest a microfiber.

Examples of the method for giving the elastic polymer to the sheet-form object include a wet solidifying method (a) of impregnating the sheet-form object with a solution of the polymeric elastomer, and further immersing the resultant in an aqueous solution or an organic solvent aqueous solution to solidify the polymeric elastomer, a dry solidifying method (b) of impregnating the object with a solution of the polymeric elastomer, and then drying the resultant to solidify the elastomer, and a method (c) of impregnating the object with a solution of the polymeric elastomer, and then subjecting the resultant to a hygrothermal treatment to solidify the polymeric elastomer thermally.

The solvent used in the polymeric elastomer solution may be, for example, N,N-dimethylformamide, dimethylsulfoxide, methyl ethyl ketone, or water. Into the polymeric elastomer solution may be optionally added a pigment, an ultraviolet absorbent, an antioxidant and others.

In embodiments of the invention, at least one surface of the artificial leather is subjected to a nap-raising treatment to form a filament-nap-raised surface. The method for forming the filament-nap-raised surface may be selected from various methods, for example, buffing or a nap-raising treatment with a sand paper piece or some other.

In the invention, an embodiment wherein an antistatic agent is given to the artificial leather before the filament-nap-raised surface is formed is a preferred embodiment since the grinding dust generated from the artificial leather by the grinding thereof tends not to be easily deposited onto the sand paper piece. By giving a silicone or some other as a lubricant thereto before the filament-nap-raised surface is formed, the nap raising by surface grinding is easily attained so that the surface quality becomes very good. If the breaking strength of the microfiber is weak, the microfiber is cut in the nap-raising treatment so that a raised nap is not satisfactorily formed; thus, the length of the raised nap becomes short. If the raised nap length is short, an elegant appearance is not easily obtained. If the raised nap length is too long, pilling tends to be easily caused. Thus, the raised nap length is preferably 0.20 or more and 1.00 mm or less.

The pilling-resistant artificial leather of the invention may be dyed. The method for the dyeing is preferably a method using a liquid flow dyeing machine since the method makes it possible to produce a kneading effect to the artificial leather while dyeing the artificial leather, thereby making the leather softer. The liquid flow dyeing machine may be an ordinary liquid flow dyeing machine. If the temperature for the dying is too high, the polymeric elastomer may be deteriorated. Reversely, if the temperature is too low, the fiber is not sufficiently dyed. Thus, it is preferred to vary the temperature in accordance with the kind of the fiber. Specifically, in general, the dyeing temperature is preferably 80° C. or higher and 150° C. or lower, more preferably 110° C. or higher and 130° C. or lower. In the case of dyeing the artificial leather with a disperse dye, the artificial leather may be subjected to reduction washing after the dyeing.

In order to improve the evenness or reproducibility of the dyeing, a dyeing aid may be used in the dyeing. This is also a preferred embodiment. Furthermore, the artificial leather may be subjected to a finishing treatment with a finishing agent, for example, silicone or any other softening agent, an antistatic agent, a water repellent agent, a flame retardant, a light-resistant agent, a deodorant, or a pilling-resistant agent. Such a finishing treatment may be conducted after the dyeing, or conducted in the same bath as that used for the dyeing.

EXAMPLES

The following describes the pilling-resistant artificial leather of embodiments of the invention in more detail by way of working examples. However, the invention is not limited only to the examples. In the invention, evaluating methods are as described below.

[Evaluating Methods]

(1) Content of Inorganic Particles in a Microfiber

A microfiber obtained from nap-raised regions of any artificial leather surface was dissolved in a solvent or the like (when the microfiber is made of polyethylene terephthalate, o-chlorophenol is used), and then the resultant was filtrated to collect inorganic particles, which are an insoluble matter. The collected inorganic particles were subjected to fluorescent X-ray analysis to identify the constituting elements thereof, and further the respective intensities in quantity of the inorganic elements were compared with calibration curves from standard substances to determine the elements quantitatively. Moreover, the inorganic particles were subjected to X-ray diffraction analysis to identify the inorganic substances by comparison with data of standard substances.

(2) Content of a Silicone Oil in a Microfiber

A microfiber obtained from nap-raised regions of any artificial leather surface was subjected to solid NMR analysis using a 29Si probe. By comparison with standard substances, the silicone oil therein was identified and the content thereof was calculated out.

(3) Breaking Strength of a Microfiber

In accordance with JIS-L1013 (1999), a sea component was taken out from any sea-island fiber obtained by melt spinning, so as to manifest a microfiber. The breaking strength thereof was measured. Next, the polymer density thereof was used to convert the strength to the strength per filament diameter of the fiber.

(4) Evaluation of the Pilling of an Artificial Leather

A tester, model 406, manufactured by James H. Heal & Co. was used as a Martingale tester, and a cloth, ABRASTIVE CLOTH SM25, manufactured by the same company was used as a standard abrasive cloth to apply a load of 12 kPa to any artificial leather sample. Under a condition that the number of times of abrasion was 20,000, the artificial leather was abraded therewith. Thereafter, the appearance of the artificial leather was observed with the naked eye, and evaluated. The criterion for the evaluation is as follows: when the artificial leather is an artificial leather the appearance of which is not changed at all before and after the abrasion, the leather is classified into class 5, and when the artificial leather is an artificial leather wherein many pills are generated, the leather is classified into class 1; and results therebetween are divided at 0.5-class intervals.

(5) Evaluation of the Appearance Quality of an Artificial Leather

Evaluators of the appearance quality of any artificial leather were 10 healthy male adults and 10 healthy female adults, the total number of which was 20. The artificial leather was evaluated into any one of the following classes with the naked eye and by sensory estimation, and the class selected by most of the evaluators was defined as the quality of the appearance:

Class 3: The fiber filament dispersed state is good, and the appearance is also good.

Class 2: The fiber filament dispersed state is poor, or the appearance is poor.

Class 1: The fiber filament dispersed state is poor as a whole, and the appearance is also poor.

(6) Raised Nap Length of an Artificial Leather

Any artificial leather was wound around a circular column having a diameter of 2 cm. While light was radiated thereto from a side thereof, the artificial leather was photographed from a position that faced to the light. The respective lengths of nap-raised regions raised from the artificial leather were measured with a scale, and the average thereof was calculated. The position for the photographing was changed to take 100 photographs, and the average obtained from measurements thereof was defined as the raised nap length.

(7) The Number of Times of Thread Breakage

About the evaluation of the spinnability, the number of times of thread breakage generated in the melt spinning thereof over 24 hours was defined as the number of times of thread breakage.

Example 1

Depolymerized was polyethylene terephthalate containing 5.0% by mass of calcium carbonate having an average particle diameter of 50 nm, and 0.4% by mass of a silicone oil containing, as a component thereof, polymethylphenylsiloxane. Into a transesterification can were charged 100 parts by mass of the resultant calcium-carbonate/silicone-containing terephthalic acid, 75 parts by mass of a sufficiently stirred ethylene glycol slurry, and 0.05 part by mass of magnesium acetate and 0.04 part by mass of antimony trioxide as reaction catalysts. Next, this was gradually heated from a temperature of 150° C. to a temperature of 250° C. in a nitrogen atmosphere. While produced methanol was extracted, a transesterification reaction was conducted. Thereafter, while the pressure was gradually reduced, the temperature was raised to 280° C. to polymerize the monomers for 2 hours, thereby yielding polyethylene terephthalate chips containing the calcium carbonate and the silicone.

Next, use was made of 45 parts by mass of polystyrene as a sea component, and 55 parts by mass of the calcium-carbonate/silicone-containing polyethylene terephthalate chips as an island component, and these components were melt-spun into a sea-island fiber. The resultant sea-island type fiber was in the form that 36 islands of the island component were contained in each filament. The monofilament diameter was 16 μm. No thread breakage was caused within 24 hours from the start of the spinning. The sea-island type fiber was cut into a fiber filament length of 51 mm, and the resultant staple was used to produce a fiber filament stacked web by making use of carding and a cross lapper. Next, the produced fiber filament stacked web was subjected to needle punch at a needle density of 100 needles/cm$^2$ to prepare a preliminary entangled nonwoven fabric. A plain-woven polyester scrim wherein the mass per unit area was 75 g/m$^2$ was laid onto each surface of the resultant preliminary entangled nonwoven fabric, and then the resultant was subjected to needle punch at a needle density of 2500 felt needles/cm$^2$ to produce a nonwoven fabric wherein the mass per unit area was 650 g/m$^2$.

The thus-obtained nonwoven fabric was shrunken with hot water at a temperature of 96° C., and then impregnated with an aqueous solution of a polyvinyl alcohol. Next, the nonwoven fabric was dried with hot wind at a drying temperature of 125° C. for 10 minutes to yield a sheet-form object to which the polyvinyl alcohol was supplied to set the proportion by mass of the polyvinyl alcohol to the island component in the nonwoven fabric to 45% by mass. About the thus-yielded sheet-form object, the sea component was dissolved in trichloroethylene to be removed. This step gave a sea-component-removed sheet wherein the microfiber filaments were entangled with each other.

The resultant sea-component-removed sheet-form object, which was made of the microfiber, was impregnated with a solution of an ether-type polyurethane resin in DMF (N,N-dimethylformamide) wherein the solid concentration was adjusted to 12% by mass, and then the polyurethane was solidified in a 30% by mass solution of DMF in water. Thereafter, the polyvinyl alcohol and DMF were removed with hot water, and then the sheet-form object was dried with hot wind at a drying temperature of 120° C. for 10 minutes to yield a polyurethane resin-supplied sheet-form object wherein the proportion by mass of the polyurethane resin to the polyester component in the nonwoven fabric was set to 30% by mass.

The resultant sheet-form object was cut into halves along the thickness direction, and one of the half-cut planes was ground with a 240-mesh endless sand paper piece, thereby being subjected to a nap-raising treatment. Thereafter, a circular dyeing machine was used to dye the sheet-form object with a disperse dye to yield an artificial leather. The proportion by mass of the polyester microfiber to the fibers contained in the resultant artificial leather was 60% by mass, and the monofilament diameter was 4.4 μm. The content of the calcium carbonate in the polyester microfiber was 1.0% by mass, and the content of the silicone oil therein was 0.08% by mass. The breaking strength of the polyester microfiber was 0.42 cN/μm. The pilling evaluation of the resultant artificial leather was from class 4 to class 5, and the appearance quality was class 4. The average raised nap length was 0.31 mm. In the spinning, no thread breakage was caused. The structure of the artificial leather is shown in Table 1, and evaluation results of the performance thereof in Table 2.

Examples 2 to 4

Artificial leathers were each yielded in the same way as in Example 1 except that the kind of the added inorganic particles, the amount of the inorganic particles, and the addition amount of the silicone oil were changed as shown in Table 1. The structure of each of the artificial leathers is shown in Table 1, and evaluation results of the performance thereof in Table 2.

Example 5

Into a transesterification can were charged 100 parts by mass of dimethyl terephthalate, 75 parts by mass of a sufficiently stirred ethylene glycol slurry containing 0.3% by mass of calcium carbonate having an average particle diameter of 50 nm, and 0.03% by mass of a polymethylphenylsiloxane oil, and 0.05 part by mass of magnesium acetate and 0.04 part by mass of antimony trioxide as reaction catalysts. Next, this was gradually heated from a temperature of 150° C. to a temperature of 250° C. in a nitrogen atmosphere. While produced methanol was extracted, a transesterification reaction was conducted. Thereafter, while the pressure was gradually reduced, the temperature was raised to 280° C. to polymerize the monomers for 2 hours, thereby yielding polyethylene terephthalate chips containing the calcium carbonate. In the same way as in Example 1 except these steps, an artificial leather was yielded. The structure of the artificial leather is shown in Table 1, and evaluation results of the performance thereof in Table 2.

Example 6

Use was made of 45 parts by mass of polyethylene terephthalate wherein sodium 5-sulfoisophthalate was copolymerized in a proportion of 8% by mol as a sea component, and 55 parts by mass of polyethylene terephthalate containing 5.0% by mass of the same calcium carbonate as in Example 1, which had an average particle diameter of 50 nm, and 0.4% by mass of a silicone oil containing, as a component, polymethylphenylsiloxane, and these components were melt-spun into a sea-island fiber. The resultant sea-island type fiber was in the form that 36 islands of the island component were contained in each filament. The monofilament diameter was 16 μm. The sea-island type fiber was cut into a fiber filament length of 51 mm, and the resultant staple was used to produce a fiber filament stacked web by making use of carding and a cross lapper. This web was subjected to needle punch at a needle density of 100 needles/cm$^2$ to prepare a preliminary entangled nonwoven fabric. A plain-woven polyester scrim wherein the mass per unit area was 75 g/m$^2$ was laid onto each surface of the preliminary entangled nonwoven fabric, and then the resultant was subjected to needle punch at a needle density of 2500 felt needles/cm$^2$ to produce a nonwoven fabric wherein the mass per unit area was 650 g/m$^2$.

The thus-obtained nonwoven fabric was shrunken with hot water at a temperature of 80° C., and then dried with hot wind at a drying temperature of 125° C. for 10 minutes. The resultant nonwoven fabric was impregnated with a solution of an ether-type polyurethane dispersed in water, the solid concentration in the solution being adjusted to 12% by mass. The nonwoven fabric was then dried with hot wind at a drying temperature of 20° C. for 10 minutes to solidify the polyurethane. Next, the resultant sheet-form object was immersed in a 15 g/L solution of sodium hydroxide in water, which was heated to a temperature of 80° C., so as to be treated therewith for 30 minutes. In this way, the sea component of the sea-island type fiber was removed to yield a polyurethane resin-supplied and sea-component-removed sheet-form object wherein the proportion by mass of the polyurethane to the polyester component in the nonwoven fabric was set to 30% by mass.

The resultant sea-component-removed sheet-form object was cut into halves along the thickness direction, and one of the half-cut planes was ground with a 240-mesh endless sand paper piece, thereby being subjected to a nap-raising treatment. Thereafter, a circular dyeing machine was used to dye the sheet-form object with a disperse dye to yield an artificial leather. The proportion by mass of the polyester microfiber to the fibers contained in the resultant artificial leather was 60% by mass, and the monofilament diameter was 4.4 μm. The content of the calcium carbonate in the polyester microfiber was 1.0% by mass, and the content of the silicone oil therein was 0.08% by mass. The structure of the artificial leather is shown in Table 1, and evaluation results of the performance thereof in Table 2.

Examples 7 to 9

Artificial leathers were each yielded in the same way as in Example 1 except that the amount of the added inorganic particles, and the addition amount of the silicone oil were changed. The structure of each of the artificial leathers is shown in Table 1, and evaluation results of the performance thereof in Table 2.

Example 10

An artificial leather was yielded in the same way as in Example 1 except that the number of the islands of the island component in each filament of the sea-island type fiber yielded in the same way as in Example 1 was changed to 200. The monofilament diameter of the fiber contained in the resultant artificial leather was 0.5 μm. The structure of the artificial leather is shown in Table 1, and evaluation results of the performance thereof in Table 2.

Example 11

An artificial leather was yielded in the same way as in Example 1 except that the number of the islands of the island component in each filament of the sea-island type fiber yielded in the same way as in Example 1 was changed to 8. The monofilament diameter of the fiber contained in the resultant artificial leather was 9.5 μm. The structure of the artificial leather is shown in Table 1, and evaluation results of the performance thereof in Table 2.

Example 12

An artificial leather was yielded in the same way as in Example 1 except that the component proportions in the composition of the microfiber were changed as shown in Table 1. The Results are Shown in Table 1.

Specifically, polyethylene terephthalate chips yielded in the same way as in Example 1, and 6-nylon chips were separately used, and then melted by use of separate extruders. The melted polymers were then joined with each other in a mouthpiece, and the resultant was jetted out from a hollow mouthpiece under a condition that the jetting-out amount per hole was set to 2 g/minute. The jetted-out material was pulled out at a high speed under an ejector pressure of 343 kPa (3.5 kg/cm$^2$). Thereafter, a high voltage of −30 kV was applied to the pulled-out material to cause the material together with a flow of the air to collide with a dispersing plate. In this way, the filaments were opened to produce fiber webs each made of a peeling-separation type composite long fiber (fiber filament diameter: 16.7 μm, and hollow percentage: 4%) having a 16-section-divided, multilayer-stacked type section. A collecting net conveyer was then used to collect the webs to set the mass thereof per unit area to 41 g/m$^2$.

An embossing calendar having upper and lower members of 100° C. temperature was used to bond filaments of each of the webs thermally to each other lightly. Across layer was used to stack 16 webs out of the fiber webs onto each other, and then the resultant workpiece was subjected to an entangling treatment by needle punch. Thereafter, the workpiece was immersed in water, and lightly wrung through a mangle. Thereafter, a sheet-form-object-hitting kneading machine was used to subject the composite fiber to a separating treatment for being converted into microfiber filaments. In this way, a nonwoven fabric was yielded wherein the mass per unit area was 650 g/m$^2$. A polyurethane was supplied to the thus-yielded nonwoven fabric in the same way as in Example 1. The workpiece was then cut into halves, and one of the halves was subjected to a nap-raising treatment, and then dyed to yield an artificial leather. The monofilament diameter of the fiber contained in the resultant artificial leather was 8.2 μm. The structure of the artificial leather is shown in Table 1, and evaluation results of the performance thereof in Table 2.

Example 13

An artificial leather was yielded in the same way as in Example 1 except that instead of the plain-woven polyester scrim laid onto each of the two surfaces of the preliminary entangled nonwoven fabric used in Example 1, use was made of a plain-woven polyester scrim made of polyethylene terephthalate containing 1% by mass of the calcium carbonate and 0.08% by mass of the silicone oil. The structure of the artificial leather is shown in Table 1, and evaluation results of the performance thereof in Table 2.

Comparative Examples 1 to 3

Artificial leathers were each yielded in the same way as in Example 1 except that use was made of the polyester containing neither inorganic particles nor any silicone oil, or the polyester containing no inorganic particles or no silicone oil. In Comparative Example 1, the polyester contained neither inorganic particles nor any silicone oil; thus, the pilling evaluation was class 2. In Comparative Example 2, the polyester contained no silicone oil; thus, the raised nap length was short so that the appearance was poor. In Comparative Example 3, the polyester contained no inorganic particles; thus, the pilling evaluation was class 2. The structure of each of the artificial leathers is shown in Table 1, and evaluation results of the performance thereof in Table 2.

Comparative Example 4

An artificial leather was yielded in the same way as in Example 1 except that the kind of the added inorganic particles, the amount of the inorganic particles, and the addition amount of the silicone oil were changed. In the resultant artificial leather, the content of the inorganic particles was large; thus, the raised nap length was short and the appearance was poor. The structure of the artificial leather is shown in Table 1, and evaluation results of the performance thereof in Table 2.

Comparative Example 5

An artificial leather was yielded in the same way as in Example 1 except that the component proportions in the composition of the microfiber were changed as shown in Table 1. In the resultant artificial leather, the proportion of the microfiber other than the polyester was large so that the different fiber filaments were entangled with each other. Thus, the pilling evaluation was class 3. The artificial leather was uneven in color so that the appearance evaluation was class 2.5. The structure of the artificial leather is shown in Table 1, and evaluation results of the performance thereof in Table 2.

TABLE 1

| | Microfiber polymer composition | Inorganic particles | Content (% by mass) of inorganic particles in polyester microfiner | Content (% by mass) of silione oil in polyester microfiber | Polyester microfiber breaking strength (cN/μm) | Scrim raw material |
|---|---|---|---|---|---|---|
| Example 1 | PET: 100% | Calcium carbonate | 1.0 | 0.08 | 0.42 | PET |
| Example 2 | PET: 100% | Calcium carbonate | 0.12 | 0.01 | 0.45 | PET |
| Example 3 | PET: 100% | Silica | 1.0 | 0.08 | 0.41 | PET |
| Example 4 | PET: 100% | Titanium oxide | 1.0 | 0.08 | 0.40 | PET |
| Example 5 | PET: 100% | Calcium carbonate | 1.0 | 0.08 | 0.39 | PET |
| Example 6 | PET: 100% | Calcium carbonate | 1.0 | 0.08 | 0.40 | PET |
| Example 7 | PET: 100% | Calcium carbonate | 3.5 | 0.5 | 0.35 | PET |
| Example 8 | PET: 100% | Calcium carbonate | 4.5 | 0.8 | 0.30 | PET |
| Example 9 | PET: 100% | Calcium carbonate | 0.03 | 0.003 | 0.48 | PET |
| Example 10 | PET: 100% | Calcium carbonate | 1.0 | 0.08 | 0.38 | PET |
| Example 11 | PET: 100% | Calcium carbonate | 1.0 | 0.08 | 0.39 | PET |
| Example 12 | PET: 90% S-Nylon: 10% | Calcium carbonate | 1.0 | 0.08 | 0.42 | PET |
| Example 13 | PET: 100% | Calcium carbonate | 1.0 | 0.08 | 0.42 | PET containing 1% by mass of calcium carbonate, and 0.08% by mass of silicone oil |
| Comparative Example 1 | PET: 100% | None | 0 | 0 | 0.60 | PET |
| Comparative Example 2 | PET: 100% | Calcium carbonate | 1.0 | 0 | 0.32 | PET |
| Comparative Example 3 | PET: 100% | None | 0 | 0.8 | 0.58 | PET |
| Comparative Example 4 | PET: 100% | Calcium carbonate | 7.0 | 0.8 | 0.10 | PET |
| Comparative Example 5 | PET: 80% 6-Nylon: 20% | Calcium carbonate | 1.0 | 0.08 | 0.42 | PET |

PET: Polyethylene terephthalate

In Table 1, any proportion in the item "Microfiber polymer composition" represents % by mass.

TABLE 2

| | Pilling evaluation | Apperance evaluation | Raised nap length (mm) | Number of times of thread breakage |
|---|---|---|---|---|
| Example 1 | Class 4.5 | Class 3 | 0.31 | 0 |
| Example 2 | Class 4 | Class 3 | 0.36 | 0 |
| Example 3 | Class 4.5 | Class 3 | 0.32 | 0 |
| Example 4 | Class 4.5 | Class 3 | 0.31 | 0 |
| Example 5 | Class 4.5 | Class 3 | 0.33 | 0 |
| Example 6 | Class 4.5 | Class 3 | 0.32 | 0 |
| Example 7 | Class 4.5 | Class 3 | 0.29 | 0 |
| Example 8 | Class 4.5 | Class 3 | 0.23 | 0 |
| Example 9 | Class 3 | Class 3 | 0.40 | 0 |
| Example 10 | Class 4.5 | Class 3 | 0.23 | 0 |
| Example 11 | Class 4 | Class 3 | 0.46 | 0 |
| Example 12 | Class 4 | Class 3 | 0.43 | 0 |
| Example 13 | Class 4.5 | Class 3 | 0.32 | 0 |
| Comparative Example 1 | Class 2 | Class 3 | 0.44 | 0 |
| Comparative Example 2 | Class 2.5 | Class 2 | 0.18 | 5 |
| Comparative Example 3 | Class 2 | Class 3 | 0.43 | 0 |
| Comparative Example 4 | Class 4.5 | Class 1 | 0.05 | 3 |
| Comparative Example 5 | Class 3 | Class 2.5 | 0.45 | 0 |

The invention claimed is:

1. A pilling-resistant artificial leather, which is a sheet-form object comprising a microfiber having a monofilament diameter of 0.3 to 10 μm and a polymeric elastomer, and having a raised nap comprising the microfiber, wherein the microfiber comprises polyethylene terephthalate, and the microfiber further comprises therein inorganic particles in a proportion of 0.01 to 5% by mass relative to 100% by mass of the microfiber, and a silicone oil in a proportion of 0.001 to 0.08% by mass relative to 100% by mass of the microfiber, wherein the average diameter of the inorganic particles is between about 0.1 nm to about 300 nm, and wherein the inorganic particles are inorganic particles of at least one selected from the group consisting of calcium carbonate, calcium chloride, and calcium sulfate.

2. The pilling-resistant artificial leather according to claim 1, wherein the microfiber comprises a polyester microfiber in a proportion of 90% by mass or more relative to 100% by mass of the microfiber.

3. The pilling-resistant artificial leather according to claim 1, wherein the microfiber is a polyester microfiber.

4. The pilling-resistant artificial leather according to claim 1, wherein the inorganic particles further comprise inorganic particles of at least one of silica and titanium oxide.

5. The pilling-resistant artificial leather according to claim 1, wherein the inorganic particles are dispersed within the microfiber.

6. The pilling-resistant artificial leather according to claim 1, wherein the inorganic particles are affinitive to the silicone oil.

7. The pilling-resistant artificial leather according to claim 1, wherein the average diameter of the inorganic particles is between about 1 nm to about 100 nm.

8. The pilling-resistant artificial leather according to claim 7, wherein the average diameter of the inorganic particles is between about 30 nm to about 50 nm.

* * * * *